US005209589A

United States Patent [19]

Bliss

[11] Patent Number: 5,209,589

[45] Date of Patent: May 11, 1993

[54] APPARATUS AND METHOD FOR MINIMIZING PRINTER SCAN ERROR

[75] Inventor: Anitta L. Bliss, San Jose, Calif.

[73] Assignee: Apple Computer, Inc., Cupertino, Calif.

[21] Appl. No.: 782,674

[22] Filed: Oct. 25, 1991

[51] Int. Cl.[5] ..... B41J 19/92

[52] U.S. Cl. ..... 400/568; 400/636; 400/641; 400/583; 400/704; 400/555; 226/30

[58] Field of Search ..... 400/555, 568, 569, 636, 400/636.2, 641, 902, 583, 583.4, 53, 704; 101/181; 226/24, 27, 28, 29, 30, 2; 346/134, 136

[56] References Cited

U.S. PATENT DOCUMENTS

| | | | |
|---|---|---|---|
| 4,734,868 | 3/1988 | DeLacy | 400/583 |
| 4,807,790 | 2/1989 | Ushioda et al. | 226/2 |
| 4,916,638 | 4/1990 | Haselby et al. | 346/154 |
| 5,131,770 | 7/1992 | Kanemitsu | 400/703 |
| 5,138,341 | 8/1992 | Kobayashi | 226/24 |

FOREIGN PATENT DOCUMENTS

| | | | |
|---|---|---|---|
| 167280 | 10/1982 | Japan | 400/568 |
| 151080 | 8/1985 | Japan | 400/568 |
| 228173 | 11/1985 | Japan | 400/568 |
| 58784 | 3/1986 | Japan | 400/706 |
| 87376 | 4/1987 | Japan | 400/568 |
| 117756 | 5/1987 | Japan | 400/568 |
| 169662 | 7/1987 | Japan | 400/555 |
| 115774 | 5/1988 | Japan | 400/568 |
| 132076 | 6/1988 | Japan | 400/555 |
| 207674 | 8/1988 | Japan | 400/555 |
| 221065 | 9/1988 | Japan | 400/568 |
| 295285 | 12/1988 | Japan | 400/568 |
| 70467 | 3/1990 | Japan | 400/568 |
| 45366 | 2/1991 | Japan | 400/568 |

*Primary Examiner*—David A. Wiecking
*Attorney, Agent, or Firm*—Blakely, Sokoloff, Taylor & Zafman

[57] ABSTRACT

In a printer assembly including a printhead which moves in a first direction for printing on a sheet of paper, roller means having an outer cylindrical periphery that engages the sheet of paper at successive tangent points on the periphery for moving the paper in a second perpendicular direction, and driving means for rotating the roller means, an apparatus for correcting certain pre-established errors in the positioning of the sheet of paper by the roller means is described. The apparatus comprises means for controlling the driving means such that the driving means rotates the roller means in order to move the sheet of paper in a way which eliminates the pre-established errors. An arrangement for determining certain pre-established errors in the positioning of the sheet of paper by the roller means is also described. The arrangement comprises light reflecting means coupled to the roller means, light emitting and sensing means for projecting a beam of light onto the light reflecting means while the roller means is rotating, and for measuring radius at the successive tangent points on the entire periphery of the roller means to determine the pre-established errors, and storage means for storing data corresponding to the pre-established errors measured by the light emitting and sensing means. A method for correcting certain pre-established errors in the positioning of the sheet of paper by the roller means and a method for determining the certain pre-established errors in the positioning of the sheet of paper by the roller means are also described.

15 Claims, 7 Drawing Sheets

APPARATUS AND METHOD FOR MINIMIZING PRINTER SCAN ERROR

FIELD OF THE INVENTION

The present invention relates to the field of printer assemblies, and more particularly, to an apparatus for and method of minimizing scan errors of a scan printer assembly.

BACKGROUND OF THE INVENTION

One type of prior printer assembly is a scan printer assembly. The scan printer assembly includes a printhead and a paper advance system. The paper advance system generally includes a drive motor (often a stepping motor), a plurality of paper rollers and a mechanical transmission means that transmits the motion of the drive motor to the rollers. The rollers place and maintain a paper for printing on a paper platen of the printer assembly, facing the printhead. The printhead moves across the paper for printing in a direction perpendicular to the movement of the paper. The printhead prints one scan line at a time. The paper advance system advances the paper when the printhead finishes each scan line on the paper.

When printing, the printer assembly first sends control signals to the drive motor to rotate the motor for a specified time. The mechanical transmission means transmits the motion of the drive motor to rollers. The rollers rotate and drag the paper on the paper platen in a direction perpendicular to the movement of the printhead for a predetermined distance thereby forwarding the paper. The predetermined distance corresponds to the rotation of the drive motor during the specified time. Printhead control signals and data to be printed are then sent to the printhead. Under the control signals, the printhead moves across the paper and makes one scan printout on the paper. The paper is then forwarded by the paper advance system and the printhead makes another scan on the paper. The process is repeated until the printer assembly completes the printing on the paper.

One prior problem associated with this type of printer assembly is that the paper advance system of the printer assembly from time to time creates errors with respect to the movements of the paper for printing. The result is that the paper is mispositioned for printing, thereby causing printing errors.

In printing on paper, text and graphics can often be printed entirely on one scan line. However, large text (e.g. large fonts) and large graphics will often span several scan lines and thus several passes of the printhead over several scan lines will be required to print the large character or graphics. This means that during these several passes, that paper will be forwarded by the paper advance system after only portions of a character (or graphics) have been printed. It will be appreciated that paper advance errors (e.g.the rollers roll too far or too short) will cause printing errors because the top of one scan line will not meet the bottom of the next scan line. For example, if the rollers roll too far, there will often be a noticeable gap in the character being printed (the gap results from the unprinted, unwanted margin between the scan and the previous scan). If on the other hand, the errors of the paper advance system causes the paper movement for the scan to be short of the desired distance, a dark band appears where the prior scan and the current scan overlap. The errors are referred to herein as stitch errors. These stitch errors of the printer assembly degrade the printed text or graphic image and sometimes make them illegible.

One contribution in the printer assembly to the stitch errors is the runout of the paper rollers within the paper advance system. Roller runout is caused by the difference between the desired movement of a paper roller in the printer assembly and the actual movement of the roller. Roller runout is defined about a datum axis which is determined by the support shaft for the roller. Runout is the difference of any two radical points measured on the roller as it is rotated on the datum axis. One component of roller runout is caused by using elastomer rollers in the printer assembly. The elastomer rollers are employed in the printer assembly to produce high friction for the paper so that the paper tracks the movement of the rollers. Due to the elastic nature of the rollers, the radius of each of the rollers varies and runout occurs during the movement of the paper rollers. The runout can produce errors of several tenth of mils to several mils in paper movement.

One prior solution to this problem is to use non-elastomer materials for the paper rollers. However, one disadvantage of this solution is that a non-elastomer surface produces less friction and may leave marks on the paper passing through the paper rollers.

Another prior solution to the problem is to mold and grind the elastomer rollers to precise tolerances during the manufacturing process. It is, however, impractical to maintain precise tolerances with elastomer rollers because of the pliable characteristics of the elastic materials. The characteristics of the elastomer rollers may also change as they age. It is also noted that paper advance errors result from problems in the drive mechanism (e.g. runout of the motor capstan or runout of the motor shaft, etc.) and that errors from the drive mechanism are of the same order of magnitude as errors from roller runout. It will be appreciated that the total scan error is from the drive mechanism and roller runout.

Moreover, each individual printer assembly has a unique set of the errors. Also, the magnitude for each of the errors varies among individual printer assemblies.

SUMMARY AND OBJECTS OF THE INVENTION

In view of the limitations of known systems and methods, one object of the present invention is to provide techniques that minimize scan errors in a printer assembly.

In view of the limitations of known systems and methods, another object of the present invention is to provide a method and apparatus for minimizing the scan errors in the printer assembly by anticipating certain scan error of the printer assembly and storing the scan errors in the printer assembly.

In view of the limitations of known systems and methods, a further object of the present invention is to provide a method and apparatus for minimizing the certain scan errors and paper advance errors of the printer assembly using certain premeasured data stored in the printer assembly.

In view of the limitations of known systems and methods, a further object of the present invention is to provide a method and apparatus for determining the certain scan errors of the printer assembly.

These and other objects of the present invention are provided for by means of a printer assembly including a printhead which moves in a first direction for printing on a sheet of paper, roller means having an outer cylindrical periphery that engages the sheet of paper at successive tangent points on its periphery for moving the paper in a second direction which is perpendicular to the first direction, driving means for rotating the roller means, and, in accordance with one aspect of the present invention, an apparatus for correcting certain pre-established errors in the positioning of the sheet of paper by the roller means. The apparatus comprises means for controlling the driving means such that the driving means rotates the roller means in order to move the sheet of paper in a way which eliminates the pre-established errors.

In accordance with a second aspect of the present invention, an arrangement is provided for determining certain pre-established errors in the positioning of the sheet of paper by the roller means. This particular arrangement comprises:

light reflecting means coupled to the roller means;

measuring means including light emitting and sensing means projecting a beam of light reflecting means and sensing the light reflected back from said beam while the roller means is rotating for measuring the radius of the roller at successive tangent points on the entire periphery of the roller means to determine the pre-established errors; and storage means for storing data corresponding to the pre-established errors measured by the light emitting and sensing means.

These and other objects of the present invention are provided for by the methods of operation of the apparatus and arrangement described immediately above. The method of operation of the above-recited apparatus comprises the steps of:

(A) determining the pre-established errors by premeasuring the radius at the successive tangent points on the roller means; and (B) controlling the driving means such that the driving means rotates the roller means in order to move the sheet of paper in a way which eliminates the pre-established errors.

The method of operation of the above-recited arrangement comprises the steps of:

coupling a light reflecting means to the roller means;

projecting a beam of light onto the light reflecting means by means of a measuring means including a light emitting and sensing means while the roller means is rotating for measuring radius at the successive tangent points on the entire periphery of the roller means to determine the pre-established errors;

storing in a storage means data corresponding to the pre-established errors measured by the light emitting and sensing means.

Other objects, features, and advantages of the present invention will be apparent from the accompanying drawings and from the detailed description which follows below.

BRIEF DESCRIPTION OF THE DRAWINGS

The present invention is illustrated by way of example and not limitation in the figures of the accompanying drawings and in which like references indicate similar elements and in which.

DETAILED DESCRIPTION

Figure 1:
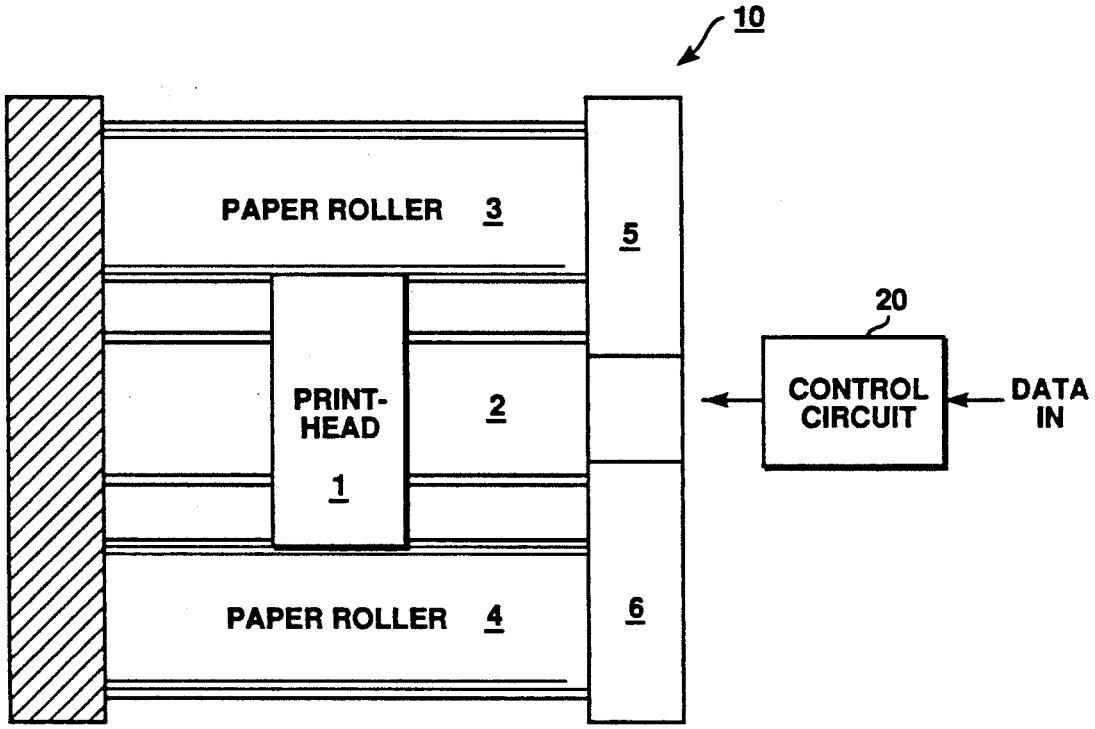
FIG. 1 is a front view of a scan printer assembly.

FIG. 1 illustrates in schematic form a front view of a printer assembly 10 on which the preferred embodiment of the present invention is implemented. In one embodiment, printer assembly 10 is a dot matrix printer assembly. In a further embodiment, printer assembly 10 is a 24 pin dot matrix printer assembly. In alternative embodiments, printer assembly 10 can be any other type of scan printer assembly.

In FIG. 1, a printhead 1 is mounted moveably on printer assembly 10 facing a paper platen 2. Printhead 1 moves across paper platen 2 and prints one scan line at a time on a paper placed on paper platen 2. Paper rollers 3 and 4 are mounted on two sides of paper platen 2. The paper on paper platen 2 is advanced and placed on paper platen 2 by paper rollers 3 and 4 for printing. Paper rollers 3 and 4 move the paper on paper platen 2 in a direction perpendicular to the movement of printhead 1. The movement of the paper on paper platen 2 by paper rollers 3 and 4 occur after each printing scan of printhead 1 on the paper is completed. Paper rollers 3 and 4 are driven by transmission gears 5 and 6. Transmission gears 5 and 6 are driven by a drive motor 12 (shown in FIG. 2) of printer assembly 10.

In one embodiment, printhead 1 is an ink-jet type of printhead. In a further embodiment, printhead 1 is a 24 pins dot matrix printhead. In alternative embodiments, printhead 1 can comprise more or fewer than 24 pins.

In a preferred embodiment, drive motor 12 is a servo motor. In alternative embodiments, drive motor 12 can be of any other type of motors. In one embodiment, paper rollers 3 and 4 are made of high friction materials so that the paper can keep precise track of the movement of paper rollers 3 and 4. In a further embodiment, paper rollers 3 and 4 are rubber rollers. In another embodiment, paper rollers 3 and 4 are made of two materials, one internal material harder than the other outer material. The outer material has higher friction than the internal material.

Printhead 1 is controlled by a control circuit 20 of printer assembly 10 to move and print. Data to be printed in a scan line is first loaded into control circuit 20. Control circuit 20 then controls the transfer of the data serially to printhead 1 and the scan movement of printhead 1 across the paper while printhead 1 is printing in order to print the data on the paper.

Control circuit 20 also controls drive motor 12 that drives transmission gears 5 and 6. Transmission gears 5 and 6 in turn rotate paper rollers 3 and 4 to advance the paper. The distance of the paper movement is controlled by control circuit 20. An external control signal is sent to control circuit 20 to control the the operation of control circuit 20.

During operation, both printhead 1 and drive motor 12 are controlled by control circuit 20 to asynchronously move within printer assembly 10. First, a control signal from control circuit 20 is sent to drive motor 12. Drive motor 12 then drives gears 5 and 6 to rotate for a specified rotation. Motion from gears 5 and 6 is then transmitted to paper rollers 3 and 4 to rotate the paper to advance on the paper on paper platen 2. The distance of each movement of the paper by paper rollers 3 and 4 is determined by control circuit 20. Printhead 1 then makes one scan printing across one scan line of the paper.

In one embodiment, printhead 1 is designed and manufactured in a rectangular shape with specified dimensions. The maximum scan width of each printing scan by printhead 1 on the paper on paper platen 2 corresponds to the print height of printhead 1. This scan width is measured in the same direction as the movement of the paper via the paper advance system and is different than the length the printhead moves in an entire scan across a page.

After each scan printing of printhead 1, paper rollers 3 and 4 are controlled to move the paper either for another scan distance corresponding to the height of printhead 1.

Figure 2:
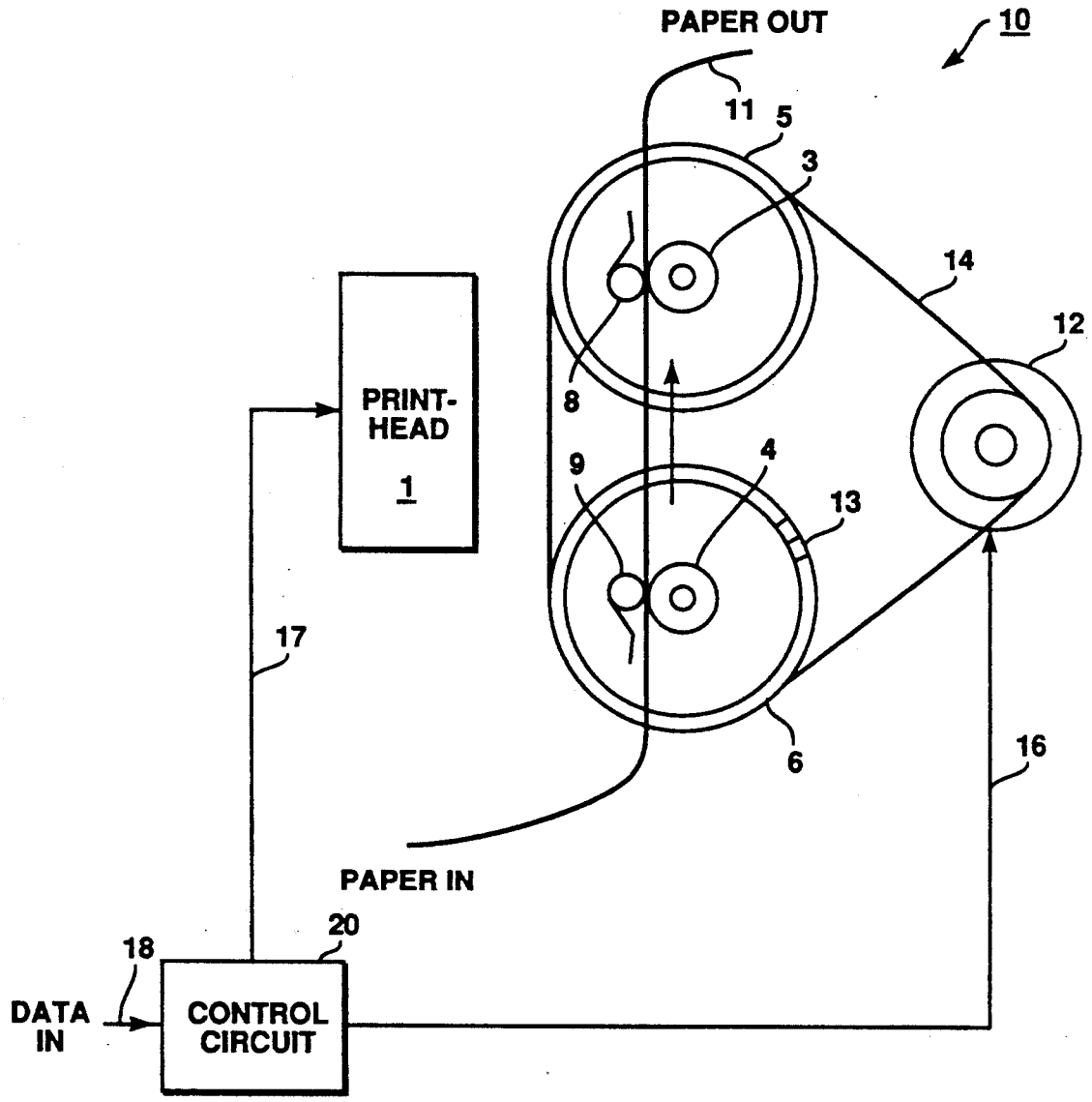
FIG. 2 is a side view of the printer assembly.

FIG. 2 illustrates in more detail a side view of printer assembly 10 shown in FIG. 1. In FIG. 2, drive motor 12 and a belt 14 are also shown. Paper rollers 3 and 4 are coupled with corresponding gears 5 and 6 respectively and are driven by gears 5 and 6 to rotate the rollers 3 and 4. Gears 5 and 6 are connected with drive motor 12 by belt 14 which transmits motion from drive motor 12 to gears 5 and 6. Transmission gears 5 and 6 each has teeth that engage with belt 14. Numeral 13 indicates a tooth in gear 6. The teeth on gears 5 and 6 provide better transmission of the motion from drive motor 12 to paper rollers 3 and 4.

Paper 11 placed on paper platen 2 (shown in FIG. 1) passes through paper rollers 3 and 4. Paper 11 is in tight contact with paper rollers 3 and 4 by rollers 8 and 9, respectively. The amount of each movement of paper 11 is determined by the degree of each rotation of paper rollers 3 and 4. After each movement of paper 11 by paper rollers 3 and 4 which are driven by drive motor 12 via belt 14 and gears 5 and 6, printhead 1 makes its scan across the paper while printing on paper 11. When paper 11 is fed from paper roller 4, paper roller 4 moves paper 11 up into the printing area where printhead 1 can make its scan printing. When paper 11 has advanced far enough to engage paper roller 3, paper roller 3 becomes the master roller that advances paper 11.

In one embodiment, transmission gears 5 and 6 are 96 tooth gears. In alternative embodiments, the teeth of gears 5 and 6 may be more or fewer than 96.

Control circuit 20 controls drive motor 12 via line 16 and printhead 1 via line 17. Paper 11 is first controlled by control circuit 20 to advance into the printing area. Data to be printed by printhead 1 on paper 11 are sent through line 18 to control circuit 20. Control circuit 20 receives, in parallel format, one scan line of data to be printed out. Control circuit 20 then serially transfers the scan data to printhead 1 for printing. At the same time, control circuit 20 controls printhead 1 to move across the paper while printhead 1 is printing, thus forming a scan printout on the paper by printhead 1. Paper 11 is then controlled to advance again by control circuit 20.

In operation, control circuit 20 first issues a control signal to drive motor 12 via line 16. Drive motor 12 is then connected to a power supply and starts to run for specified period of time. The time period is controlled by the control signal from control circuit 20. After the specified period of time elapses, the control signal to advance the motor is deasserted by control circuit 20. Drive motor 12 then is in a still condition ready for another signal from control circuit 20 to advance again.

Belt 14 transmits the motion of drive motor 12 to paper rollers 3 and 4 via gears 5 and 6. The motion is then converted to paper movements of paper 11 by paper rollers 3 and 4. The running time of drive motor 12 is reflected on paper 11 as the distance that paper 11 has advanced by paper rollers 3 and 4.

Control circuit 20 controls the running time of drive motor 12 by issuing various control signals to drive motor 12. Under the control signals drive motor 12 is caused to advance intermittently. If printhead 1 finishes scanning on a portion of a complete printout line (e.g. a large font is being printed and the font size requires several scan lines to complete the characters in the font), drive motor 12 moves paper 11 for another scan margin so that this printed portion by printhead 1 moves over printhead 1 and printhead 1 is able to print the next portion following the proceeding printed portion. Once printhead 1 completes its last scan printing for one complete printout line, a spacing margin is needed to start a new printout line. In this situation, another type of control signal is issued by control circuit 20 to drive motor 12 for a longer running period of time. Paper rollers 3 and 4 rotate paper 11 on paper platen 2 to move for the spacing margin. In the preferred, embodiment, spacing margin is formed by several scan margins.

Control circuit 20 can also issue other types of control signals (which are well known) to drive motor 12 to either initially place paper 11 within the printing area or remove paper 11 from printer assembly 10 when printing has been completed.

Control circuit 20 sends control signals and printing data to printhead 1 via line 17. Printhead 1 scans and prints after each movement of paper 11. During each movement of paper 11, data is sent to control circuit 20 for processing. After each movement of paper 11, printhead 1 then starts scan printing on paper 11.

Figure 3:
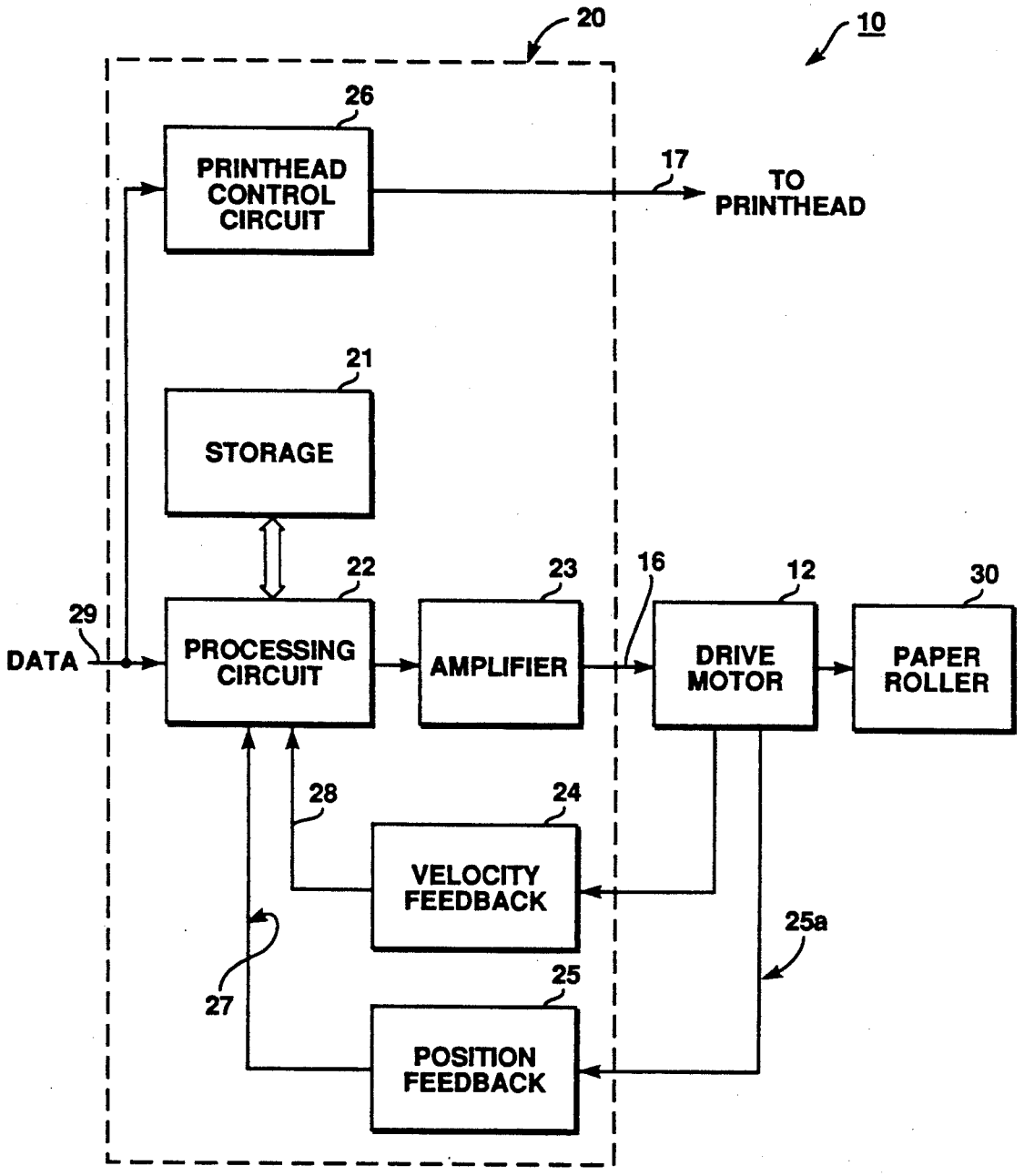
FIG. 3 is a block diagram of the control circuit of the printer assembly, including the storage.

FIG. 3 illustrates in block diagram control circuit 20 of printer assembly 10 shown in FIGS. 1 and 2.

In FIG. 3, only part of printer assembly 10 is shown in order to facilitate the description of the present invention. As can be seen from FIG. 3, control circuit 20 includes a printhead control circuit 26 that controls printhead 1 to move across the paper and print one scan line of printing on the paper at a time. Printing data is fed to control circuit 20 from external circuitry via line 29. The printing data is then sent to printhead control circuit 26. The printing data also includes a control signal that controls the movement of printhead 1 while printing.

Control circuit 20 also includes, for controlling the motion of drive motor 12, a processing circuit 22, and an amplifier 23 that is coupled to processing circuit 22 at one end and to drive motor 12 at the other end. When printer assembly 10 is required to move the paper one scan distance, a control signal is sent from external circuitry to processing circuit 22 via line 29. Processing circuit 22 then applies the control signal to amplifier 23. Amplifier 23 amplifies the control signal and sends a signal to drive motor 12 via line 16. A power supply not shown is connected to drive motor 12 by the control signal. The control signal controls the amplitude and the phase of the power that is connected to drive motor 12. Drive motor 12 then drives paper roller 30 to rotate a scan distance. For purposes of clarity, paper roller 30 represents either of the paper rollers 3 and 4 of printer assembly 10. Control circuit 20 controls the motion of drive motor 12 in order to control the position of paper roller 30. For example, when paper is first advanced to the printing area in printer assembly 10, drive motor 12 needs to rotate paper roller 30 (actually roller 4) for more than one scan distance. For position control, both velocity and position feedback are needed from drive motor 12.

Control circuit 20 includes a velocity feedback circuitry 24 and a position feedback circuitry 25. The velocity of drive motor 12 is obtained by velocity feedback circuitry 24 and is fed back to processing circuit 22 via line 28. The positional information of the motor 12 is obtained by position feedback circuitry 25, via line 25*a*, and is fed back to processing circuit 22. With the velocity and position feedback, processing circuit 22 modifies the control signal that controls the power supply of drive motor 12 to compensate for any velocity or position values that are different than the previously stored desired position and velocity values.

In accordance with the present invention, control circuit 20 further includes a storage device 21. Storage 21 stores premeasured information for the particular printer assembly 10. The premeasured information relates to the scan errors in the particular printer assembly 10 which contains the storage device 21. Each of the scan errors is premeasured and stored in storage 21. The apparatus for premeasuring the scan errors in printer assembly 10, as well as the process of measuring them will be described in more detail below.

In the presently preferred embodiment, storage 21 stores all of the predetermined angular rotations $\theta$ of roller 30 from any given tangent point on the roller's periphery for each scan advance to ensure that each scan advance is uniform or at least is equivalent to the desired advance. If not, printing (stitch) errors occur. The desired (predetermined) angular rotation $\theta$ from a positional (tangent) point on the periphery of each roller 30 is a function of the radii of that roller 30 from that point. The position point means the tangent point on the periphery of that roller 30 at which the radius is perpendicular to the paper for printing. The distance from this tangent point to the center of that roller 30 is the radius at that point. If the radius changes through a series of successive points, then $\theta$ changes. As a result, the desired $\theta$ needs to be changed in order to maintain the desired scan distance for the movement of the paper. Therefore, each desired $\theta$ information varies from point to point for roller 30. The radius at each tangent point on the periphery of each of roller 30 is premeasured so as to provide a complete profile of each of roller 30. Once this is done, the desired $\theta$ starting from any given tangent can be determined for providing a constant, accurate paper movement which then mitigates any printing error. The measurement of the radius of roller 30 and calculation of the desired $\theta$ will by described in more detail below.

Storage 21 can be of any type of storage means. In one embodiment, storage 21 is a ROM device with A/D (analog to digital) and D/A (digital to analog) converters on its corresponding sides, respectively. In alternative embodiments, other types of storage means can be employed. For example, storage 21 can be a disc storage means. A further example is an EPROM device which is able to be updated from time to time.

Storage 21 includes a lookup table for addressing the stored information. In the lookup table, the address of the desired angular rotation $\theta$ corresponding to a positional point on the surface of roller 30 is stored. When accessing the desired $\theta$ information, processing circuit 22 uses information of the positional point to address the lookup table. The address of the desired $\theta$ information at this positional point is then obtained. Processing circuit 22 then obtains the desired $\theta$ information using this address for the desired $\theta$.

During the printing operation, when a control signal is received in processing circuit 22 to advance the paper for printing a scan distance, processing circuit 22 first determines which one of roller 30 (e.g. roller 5 or 6) is advancing the paper at this moment. Then, processing circuit 22 accesses storage 21 for the desired angular rotation $\theta$ of the master one of roller 30 (typically roller 3) at the particular positional point. Processing circuit 22 obtains the actual motor positional information from position feedback circuitry 25.

Storage 21 stores all premeasured desired angular rotation $\theta$ at all points on the surface of roller 30. Therefore, processing circuit 22 can obtain the desired angular rotation $\theta$ for any variable radius of roller 30. The desired angular rotation $\theta$ in storage 21 has accounted for the variation in radius at the point. It, therefore, is the modified angular rotation $\theta$ that compensates for the paper advance errors caused by the variable radius.

Once processing circuit 22 obtains the desired angular rotation $\theta$ from storage 21, processing circuit 22 sends the signal to amplifier 23 and to drive motor 12 to control the motion of drive motor 12. Drive motor 12 accordingly increases or decreases its step size to compensate for any error that will occur during the paper advance. In this way, the scan distance for each movement of roller 30 becomes more uniform and any error which occurs in advancing the paper from one scan line printing to the next scan printing is reduced.

Figure 4:
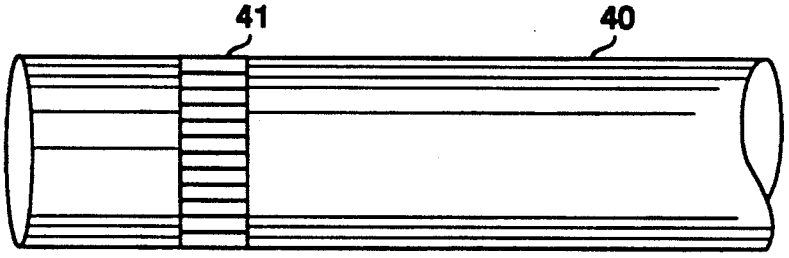
FIG. 4 is a front view of the paper roller, showing an example of implementing the reflective mark on the roller.
Figure 5:
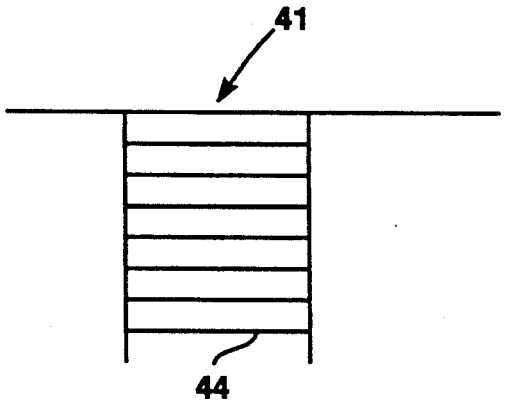
FIG. 5 is a enlarged front view of the reflective mark shown in FIG. 4.
Figure 6:
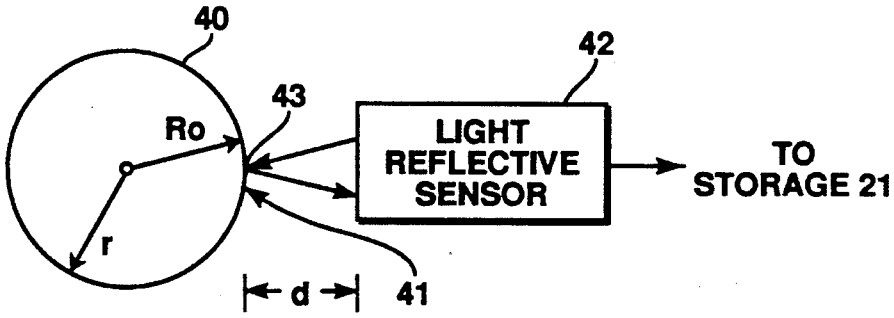
FIG. 6 a side view of the roller, showing the operation of measuring the errors in radius of the roller of FIG. 4 by a light reflective sensor.

FIGS. 4, 5 and 6 illustrate an example of premeasuring the errors in radius of one of paper rollers 3 and 4. FIGS. 4, 5 and 6 show the process of premeasuring paper roller 40 which is representative.

As shown in FIG. 4, a reflective mark 41 is incorporated into roller 40 during the manufacture of roller 40. Reflective mark 41 is reflective to light. As can be seen from FIG. 4, reflective mark 41 is placed on the cylindrical surface of roller 40. Reflective mark 41 surrounds the cylindrical surface of roller 40 in a close circle. Reflective mark 41 is placed along one side of roller 40 which is an area that paper 11 does not pass through. This is to ensure that reflective mark 41 on roller 40 does not affect the ability of roller 40 to advance paper passing through it.

In one embodiment, reflective mark 41 is a stripe mounted onto the cylindrical surface of roller 40 during the manufacture of roller 40. In a further embodiment, reflective mark 41 is a stripe layer coated on the cylindrical surface of roller 40. In one embodiment, reflective mark 41 is placed on left side of roller 40. In another embodiment, reflective mark 41 is placed on right side of roller 40.

Reflective mark 41 includes tick marks proportional to the resolution of roller 40. FIG. 5 is an enlarged view of reflective mark 41. In FIG. 5, tick marks 44 are shown. Tick marks 44 create light and dark areas on reflective mark 41. Tick marks 44 the provide rotational position of roller 40. The position is the actual rotation of roller 40 that includes predetermined movement and errors.

In the presently preferred embodiment, tick marks 44 are etched areas of reflective mark 41. The distance of any two tick marks are approximately 6 mm (for 300 DPI, 0.0033 track spacing). In another embodiment, tick marks 44 can be the protruding areas of reflective mark 41. In alternative embodiments, reflective mark 41 can be printed with different reflective materials to create different reflectance to any projecting light.

In FIG. 6, light reflective sensor 42 is mounted on printer assembly 10 facing paper roller 40. Light reflective sensor 42 and reflective mark 41 on paper roller 40 form the measuring means of printer assembly 10. Measurement is then made by light reflective sensor 42 and reflective mark 41 while paper roller 40 is advanced in printer assembly 10. In this way, is the radius profile of paper roller 40 at its successive tangent points on the periphery of roller 40 is obtained which then determines roller runout and mechanism advance errors of the particular paper roller 40 which is being measured. In the preferred embodiment, each roller for each printer is tested after the roller has been built into the particular printer assembly. In this way, the measurements are specific for each roller and thus the corrections are specific for each printer, rather than having generic corrections which do not work for every roller.

Light reflective sensor 42 includes two functions, light emitting function and light sensing function. The light emitting function of light reflective sensor 42 produces a beam of light towards the surface of reflective mark 41 on paper roller 40; this surface faces light reflective sensor 42. Tick marks 44 on reflective mark 41 change the amount of the incident light to be reflected back. The reflected light is then picked up by the light sensing function of light reflective sensor 42 and transformed into electrical signals. Light reflective sensor 42 can be designed to exclude any reflective light that is not from reflective mark 41 of paper roller 40. The light emitting function and the light sensing function of light reflective sensor 42 are within certain distances, vertically or horizontally, from each other within light reflective sensor 42. FIG. 6 shows a vertical distance. The two functions of light reflective sensor 42 can also be so arranged that the projecting beam of light from light reflective sensor 42 strikes its tangent plane on the surface of reflective mark 41 and is picked up by its light sensing function. The positional relation of light reflective sensor 42 with reflective mark 41 on paper roller 40 is kept constant during the period of measuring each advance of paper roller 40.

In one embodiment, light reflective sensor 42 is the MTI1000 Fotonic Sensor manufactured by Mechanical Technology, Inc. at Latham, N.Y. In other embodiment, the light reflective sensor 42 is a FS/FU series Optical-fiber photoelectric sensor from Keyenee Corporation of America of Torrance, Calif.

After the measurement, light reflective sensor 42 is removed from printer assembly 10 and the remainder of the manufacture of the printer is completed in the normal manner except that the storage device 21 will be programmed to compensate for paper advance errors.

For some types of printer assemblies, light reflective sensor 42 and reflective mark 41 can be mounted permanently on the printer assembly itself. In this way, the rotational movement of the paper roller can be measured constantly and the compensation (for errors in advancing the paper) changed dynamically over the lifetime of the printer assembly.

In FIG. 6, paper roller 40 is measured during each of its rotations. The measurement starts when drive motor 12 drives roller 40 through belt 14 and transmission gears 5 and 6 for a predetermined distance at each time. Light reflective sensor 42 projects a beam of light onto a point 43 of reflective mark 41 that directly faces incident light while roller 40 is rotating. As paper roller 40 rotates, reflective mark 41 follows each movement of roller 40. The beam of light striking on point 43 is then reflected back to light reflective sensor 42. Point 43 is the point of reflective mark 41 that directly receives the incident beam of light from light reflective sensor 47 at the time when roller 40 is rotating. Point 43 is also the point on the surface of roller 40 at which the radius is perpendicular to the paper for printing.

In measuring the errors in each advance of paper roller 40 at all points on the surface, paper roller 40 is driven to rotate the roller a scan distance (i.e. the distance the roller advances between one scan line and the next scan line) at a time. For each rotation of roller 40, light reflective sensor 42 receives the reflected beam of light from mark 41. The errors in each actual movement of roller 40 are then detected by light reflective sensor 42.

The varied amount of the beam of light reflected includes information about the errors in each movement of roller 40. The amount corresponds to the distance d from light reflective sensor 42 to point 43 of reflective mark 41 on the surface of roller 40. The shorter the distance d is, the larger the amount of the light is reflected. As described above, the distance d should be maintained constant during the measuring process (thus the distance between the sensor 42 and the shaft of the roller remains constant to the extent this is possible), the distance d nevertheless changes because the radius r of roller 40 varies at any point of roller 40. This affects the amount of the light reflected back to light reflective sensor 42. When the reflected light is picked up by light reflective sensor 42, the error is detected at light reflective sensor 42. Roller 40, as manufactured, is intended to have a constant radius Ro in order to provide a uniform scan distance rotation in each rotational movement of roller 40 so there is a uniform distance between printing scan lines. However, as discussed above, the radius does in fact vary from tangent point to tangent point.

Figure 7:
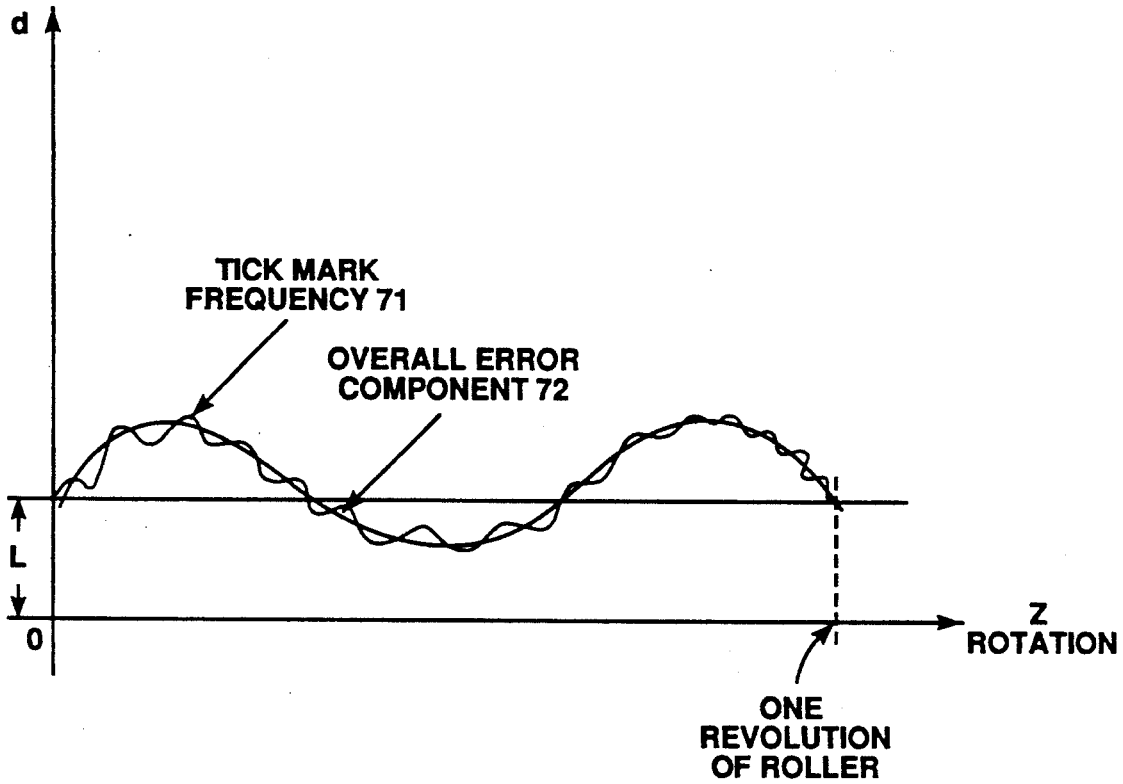
FIG. 7 is a representation of the measurement of the light reflective sensor as a function of rotation of the roller shown in FIG. 4.

The reflected light is received by light reflective sensor 42. Light reflective sensor 42 then transforms the amount of the reflected light into electrical signals to be stored in storage 21. The signal received in sensor 42 has two frequency components: (i) high frequency tick marks for the positional information and (ii) the radius error profile information of roller 40. FIG. 7 shows the waveform of the two components for a roller.

The signal is then processed by a signal process circuitry not shown to obtain the error information. First, the high frequency tick mark information can be filtered away by using a high frequency filter. Then, the DC component in the filtered error information signal can be also filtered by using a DC filter. The DC component represents the constant distance L that is maintained between sensor 42 and reflective mark 41 on the surface of roller 40. The signal process circuitry includes the high frequency filter and the DC filter. In one embodiment, the signal process circuitry is circuitry external to sensor 42 and storage 21. In alternative embodiments, the signal process circuitry can be incorporated into either sensor 42 or storage device 21.

In FIG. 7, z represents the rotation, d represents the distance from sensor 42 to point 43 of reflective mark 41. Point 43 can be any tangent point on reflective mark 41 that is facing sensor 42 at one moment. L represents the constant distance from sensor 42 to point 43. Curve 71 represents the tick mark frequency and the radius error profile. Curve 72 represents the overall radius error profile component of roller 40.

The total error of roller 40 in its rotation at any point in printer assembly 10 can be correlated to positional information. When the tick mark high frequency component 71 is removed from the waveform, it becomes curve 72 that includes only the overall radius error profile and the predetermined distance L (the predetermined distance from sensor 42 to a tangent point of roller 40 with predetermined radius at that point). The actual radius error of a given point (represented by Z, which may be an angular measurement) is then determined by the equation:

$$e(z)=d(z)-L \tag{1}$$

The actual radius of roller 40 at that given point is determined by the equation:

$$r(z)=Ro+e(z) \tag{2}$$

wherein Ro is the required radius of roller 40 (e.g. as specified by manufacturing specifications). Thus the surface rotation of roller 40 is determined as follows:

$$s(z)=r(z)\times\theta \tag{3}$$

wherein $\theta$ is the predetermined angular rotation for each scan distance rotation of roller 40. Because the radius r changes as a function of rotation z, and the surface rotation s is desired to be constant, the angular rotation of roller 40 can be adjusted to compensate for the variable radius r. A desired $\theta$ is determined for each scan advance at any given point as follows:

$$\theta(z)=s(\text{desired})/r(z) \tag{4}$$

The desired angular rotation $\theta(z)$ information for a given positional point of roller 40 is then stored at storage 21. The value s (desired) will be the desired scan advance distance which will be known. This information is used later to control servo motor 12 in rotating paper roller 40, as described above.

The measurement of paper roller 40 is complete when paper roller 40 has rotated for a complete circle. At this moment, each desired $\theta(z)$ of roller 40 has been measured by sensor 42 and has been stored in storage 21. In this way, printer assembly 10 is characterized with its own errors in paper advance movements. The desired angular rotation $\theta(z)$ at any given point of either of paper rollers 3 and 4 are determined for each scan distance.

Figure 8:
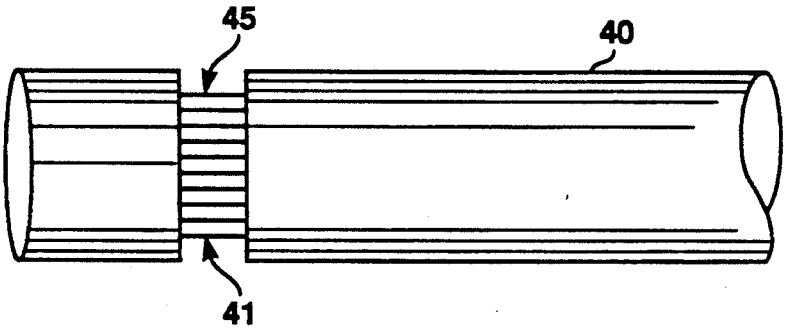
FIG. 8 is a front view of the paper roller, illustrating another example (an alternative embodiment) of implementing the reflective mark on the roller.
Figure 9:
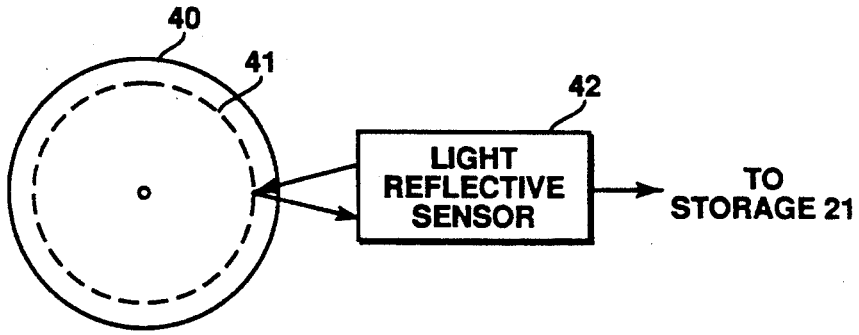
FIG. 9 shows the operation of measuring the movement of the roller of FIG. 8 by the light reflective sensor.

FIGS. 8 and 9 illustrate an alternative (but not preferred) example of implementing reflective mark 41 on roller 40 and measuring the movements of roller 40.

In FIG. 8, paper roller 40 is comprised of a recessed area 45 around its cylindrical surface. The recessed area 45 on paper roller 40 forms a closed loop on the cylindrical surface of paper roller 40. Reflective marks 41 are made on the surface of the recessed area 45 for encoding each movement of paper roller 3 into a reflected light, thus forming reflective mark 41. The recessed area 45 can be on either side of the cylindrical surface of paper roller 40. The recessed area 45 is deep enough to distinguish it from the rest of the cylindrical surface of paper roller 40. The depth of the recessed area 45 is uniformly made.

In FIG. 9, light reflective sensor 42 is mounted in printer assembly 10 facing the recessed area 45 of paper roller 40. In this implementation, light reflective sensor 42 produces and projects a beam of light towards reflective mark 41 on the surface of recessed area 45 on paper roller 40 that faces light reflective sensor 42. Reflective mark 41 alters the amount of the light to be reflected back towards light reflective sensor 42. Light reflective sensor 42 then picks up the reflected light and transforms it into electrical signals.

Figure 10:
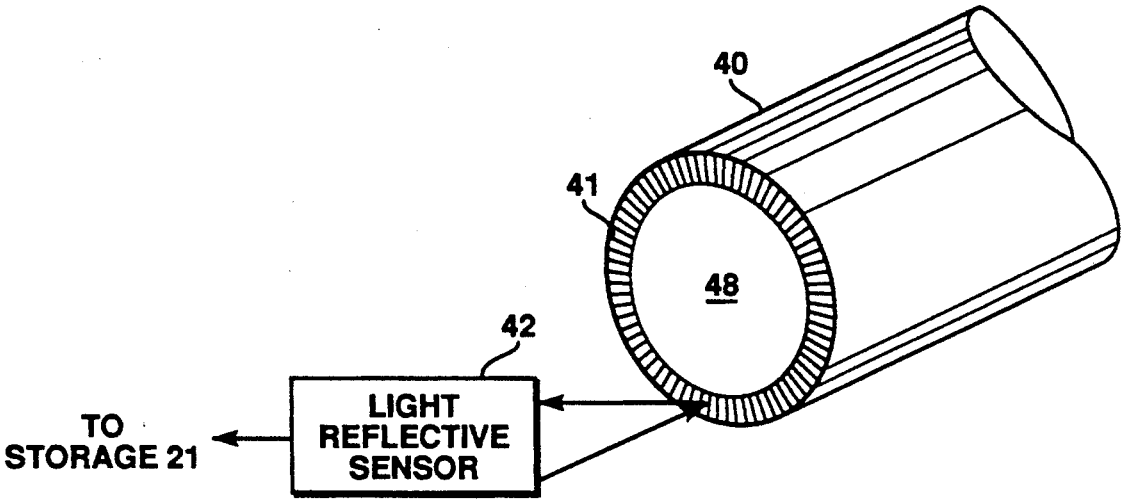
FIG. 10 is a perspective view of the roller, showing a further example of implementing the light reflective mark on the roller and the operation of measuring the errors in radius of the roller by the light reflective sensor.

FIG. 10 illustrates a further alternative example of implementing reflective mark 41 on paper roller 40 and measuring the errors in radius of roller 40.

In FIG. 10, reflective mark 41 is placed on a side surface 48 of paper roller 40. Reflective mark 41 is formed in a circle on the side surface 48 of paper roller 40. In one embodiment, reflective mark 41 is placed on the edge of side surface 48. In a further embodiment, reflective mark 41 is a close loop stripe. In another embodiment, reflective mark 41 is a coated layer on side surface 48. In a further embodiment, reflective mark 41 is formed on a circular recessed area concentric with the circumference of side surface 48. Reflective mark 41 maybe placed on either side surface of paper roller 40.

Light reflective sensor 42 is then placed facing light reflective mark 41. The distance between light reflective sensor 42 and reflective mark 41 is fixed and unchanged during measuring the movements of roller 40. As described above, light reflective sensor 42 includes the light emitting function and light sensing function. Light reflective sensor 42 produces an incident beam of light onto the part of reflective mark 41 that directly faces light reflective sensor 42.

In the foregoing specification the invention has been described with reference to specific embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. For use in a printer assembly including a printhead which moves in a first direction for printing on a sheet of paper, roller means having an outer cylindrical periphery that engages said sheet of paper at successive tangent points on said periphery for moving the paper in a second perpendicular direction, and driving means for rotating said roller means, an arrangement for determining certain pre-established errors in the positioning of said sheet of paper by said roller means, comprising:

light reflecting means coupled to said roller means;

measuring means including light emitting and sensing means projecting a beam of light onto said light reflecting means and sensing the light reflected back from said beam while said roller means is rotating for measuring the radii of said roller means at said successive tangent points on the entire periphery of said roller mens to determine said pre-established errors;

storage means for storing data corresponding to said pre-established errors measured by said light emitting and sensing means.

2. The arrangement of claim 1, wherein said light emitting and sensing means is removable from said printer assembly.

3. The arrangement of claim 2, wherein said light emitting and sensing means is a light reflective sensor.

4. The arrangement of claim 2, wherein said storage means includes a look-up table storing the relationship of said pre-established errors with a successive tangent points on the periphery of said roller means.

5. The arrangement of claim 2, wherein said storage means is a read-only memory.

6. The arrangement of claim 2, wherein said light reflecting means is a light reflective stripe mounted on the periphery of said roller means, wherein said light reflective stripe includes reflective marks.

7. The arrangement of claim 2, wherein said light reflecting means is a coated layer on said roller means, wherein said layer includes reflective marks.

8. The arrangement of claim 2, wherein said light reflecting means is a recessed area around the periphery of said roller means, wherein said recessed area includes reflective marks.

9. The arrangement of claim 2, wherein said light reflecting means is mounted around the edge of a side surface of said roller means.

10. In a printer assembly including a printhead which moves in a first direction for printing on a sheet of paper, roller means having an outer cylindrical periphery that engages said sheet of paper at successive tangent points on said periphery for moving the paper in a second perpendicular direction, and driving means for rotating said roller means, a method for correcting certain pre-established errors in the positioning of said sheet of paper by said roller means, comprising the steps of:

(A) determining said pre-established errors by premeasuring the radii of said roller mens at said successive tangent points on said roller means;

(B) controlling said driving means such that said driving means rotates said roller means in order to move said sheet of paper in a way which eliminates said pre-established errors.

11. The method of claim 10, further comprising the step of collecting data corresponding to said pre-established errors in a storage means.

12. The method of claim 11, wherein said controlling step further includes the step of using said data stored in said storage means to control said driving means to rotate said roller means such that said pre-established errors are eliminated.

13. For use in a printer assembly including a printhead which moves in a first direction for printing on a sheet of paper, roller means having an outer cylindrical periphery that engages said sheet of paper at successive tangent points on said periphery for moving the paper in a second perpendicular direction, and driving means for rotating said roller means, a method for determining certain pre-established errors in the positioning of said sheet of paper by said roller means, comprising the steps of:

coupling a light reflecting means to said roller means;

projecting a beam of light onto said light reflecting means by measuring arrangement including a light emitting and sensing means while said roller means is rotating for measuring the radii of said roller means at said successive tangent points on the entire periphery of said roller means to determine said pre-established errors;

storing in a storage means data corresponding to said pre-established errors measured by said light emitting and sensing means.

14. The method of claim 13, wherein said step of storing said data further includes the step of setting up a lookup table in said storage means.

15. The method of claim 13, further comprising the step of removing said light emitting and sensing means from said printer assembly after said step of measuring said radius said successive tangent points on the entire periphery of said roller means has been completed.

* * * * *